United States Patent [19]

Nakai

[11] Patent Number: 4,886,022

[45] Date of Patent: Dec. 12, 1989

[54] ENGINE VALVE DRIVING APPARATUS

[75] Inventor: Eiji Nakai, Yokohama, Japan

[73] Assignee: Mazda Motor Corporation, Hiroshima, Japan

[21] Appl. No.: 292,949

[22] Filed: Jan. 3, 1989

[30] Foreign Application Priority Data

Jan. 6, 1988 [JP] Japan ..... 63-332

[51] Int. Cl.[4] ..... F01L 1/34; F01L 1/04

[52] U.S. Cl. ..... 123/90.17; 123/90.6; 74/568 R

[58] Field of Search ..... 123/90.12, 90.13, 90.17, 123/90.6; 74/568 R

[56] References Cited

U.S. PATENT DOCUMENTS

| | | | |
|---|---|---|---|
| 862,448 | 8/1907 | Cornilleau | 123/90.17 |
| 4,690,110 | 9/1987 | Nishimura et al. | 123/90 |
| 4,726,332 | 2/1988 | Nishimura et al. | 123/90 |
| 4,765,289 | 10/1988 | Masuda et al. | 123/90 |
| 4,794,893 | 1/1989 | Masuda et al. | 123/90.17 |

FOREIGN PATENT DOCUMENTS

| | | | |
|---|---|---|---|
| 0704575 | 2/1941 | Fed. Rep. of Germany | 123/90.17 |
| 3720947 | 1/1988 | Fed. Rep. of Germany | 123/90.17 |
| 58-133409 | 8/1983 | Japan . | |

*Primary Examiner*—Charles J. Myhre
*Assistant Examiner*—Weilun Lo
*Attorney, Agent, or Firm*—Fleit, Jacobson, Cohn, Price, Holman & Stern

[57] ABSTRACT

Engine valve driving apparatus having a camshaft and a radially movable cam supported on the camshaft. A support is fixed to the camshaft. Both the movable cam and the fixed support are formed with holes, whose axes coincide with each other when the movable cam protrudes at its maximum outward position. A connecting pin is disposed in the hole of the fixed support and an oil supply actuates the connecting pin. When the connecting pin is forced by the oil supply, the connecting pin lifts the movable cam radially outwardly to its maximum outward position.

10 Claims, 8 Drawing Sheets

ENGINE VALVE DRIVING APPARATUS

BACKGROUND OF THE INVENTION

1. Field of the Invention

The present invention relates to an engine valve driving apparatus, and more particularly to an engine valve driving apparatus including a valve driving cam which is controlled to move radially by a hydraulic system according to engine operating conditions.

2. Description of the Prior Art

In the field of internal combustion engines, engine valve driving apparatus including an engine valve controlled to work in cooperation with a valve driving cam according to engine operating conditions are well known. One such engine valve driving apparatus is described in Japanese Patent Unexamined Publication No. 58-133,409 laid open Aug. 9, 1983. This engine valve driving apparatus has a valve driving cam which is fixed to a camshaft in the rotational directions and can be moved in the radial direction by a hydraulic system according to engine speed. However, the device taught by the above-mentioned Japanese Patent Unexamined Publication No. 58-133,409 is structurally unfavorable in stability in the high engine speed region of operation. That is, the valve driving cam in the high engine speed region is merely protruding from the camshaft without any stopper mechanism, and for that reason is inherently unstable.

SUMMARY OF THE PRESENT INVENTION

It is, therefore, an object of the present invention to provide an engine valve driving apparatus which realizes, at the same time, to move a valve driving cam in the radial direction of a camshaft and fix it at its maximum protruding position by shifting a connecting pin.

It is another object of the present invention to provide an engine valve driving apparatus which has a greatly improved reliability.

In accordance with the present invention, a fixed member is provided on the camshaft, so that the fixed member is located adjacent to a cam member which is mounted on the camshaft movable in the radial direction. The engaging holes are formed in both the fixed member and the movable cam member. The engaging holes have axes inclined at the same angle relative to the axis of the camshaft, each axis lying on one common straight line when the movable cam member protrudes at its maximum position. A connecting pin is disposed in the hole of the fixed member. The connecting pin can move the movable cam member up to the maximum protruding position by changing its position from the hole of the fixed member to the hole of the movable cam member. Also, the connecting pin can fix the movable cam member at the maximum protruding position.

When the movable cam member is used as a high speed cam member and a low speed cam member is fixed on the cam shaft, this movable cam member is disposed adjacent to the low speed cam member and protrudes outwardly beyond the low speed cam member at its maximum protruding position so as to increase the valve lift amount. In this case, the fixed member is disposed adjacent to the movable member on the opposite side of the low speed cam with respect to the movable member. Also, the connecting pin is mounted slidably in the fixed member.

The above and other objects and features of the present invention will become apparent from the following description of a preferred embodiment taking reference to the accompanying drawings.

DESCRIPTION OF THE PREFERRED EMBODIMENT

1. First Embodiment of the Present Invention

Figure 1:
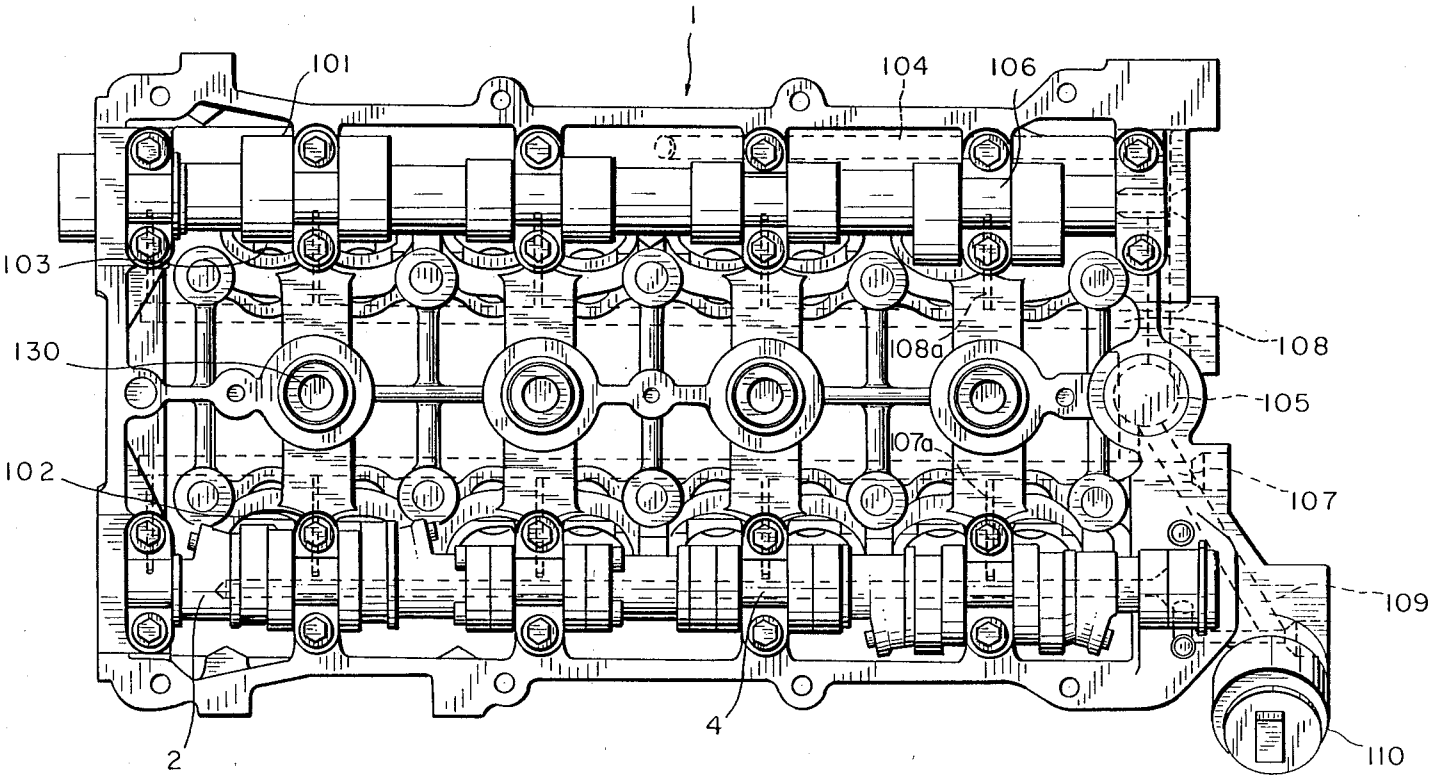
FIG. 1 is a plan view of the valve driving apparatus according to a first embodiment of the present invention.

Referring to the FIG. 1 there is shown a cylinder head 1 of an internal combustion engine. The cylinder head 1 has an intake camshaft 2, an exhaust camshaft 101, tappet holes 102 for hydraulic lash adjusters of intake valves, tappet holes 103 for hydraulic lash adjusters of exhaust valves, and plug hole 130. The cylinder head 1 comprises main oil passage 104 which lead oil from a main gallery of the cylinder block and an oil pool 105 preserving oil supplied from the main oil passage 104. There is provided oil passages 107 and 108 for intake valves and exhaust valves respectively. The oil passages 107 and 108 supply oil from the oil pool 105 to hydraulic lash adjusters and cam journals 4 and 106. Further, driving oil passage 109 is provided to supply oil to intake valve camshaft having a valve driving means.

Figure 11:
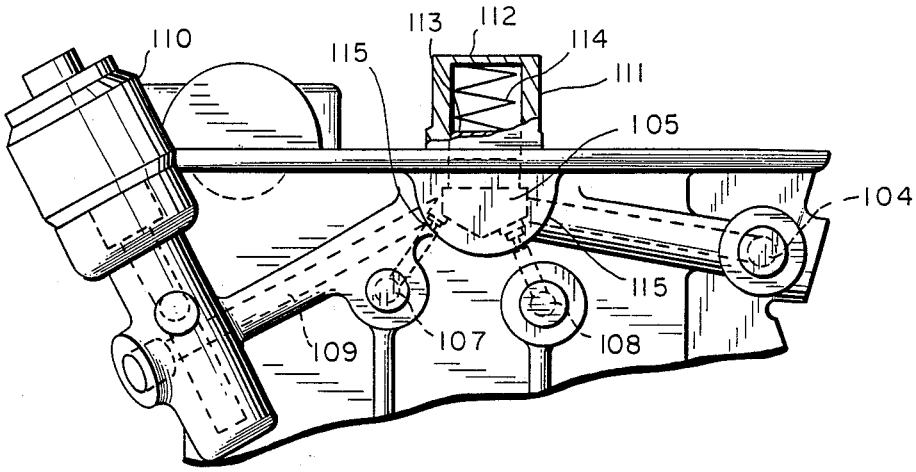
FIG. 11 is a front view of the valve driving apparatus seen from the right hand side of FIG. 1.
Figure 12:
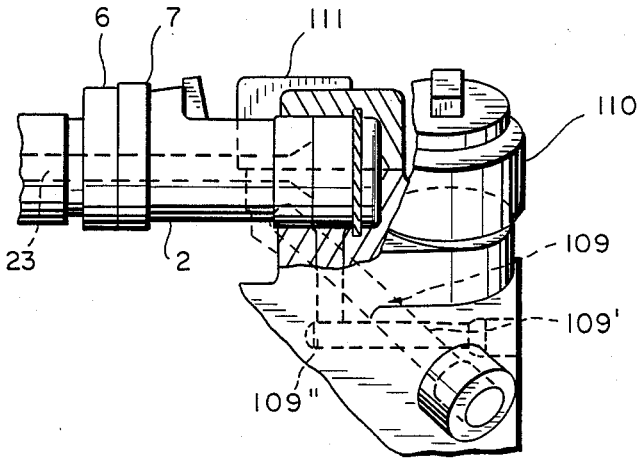
FIG. 12 is an axial sectional side view of FIG. 1 with certain part omitted.
Figure 13:
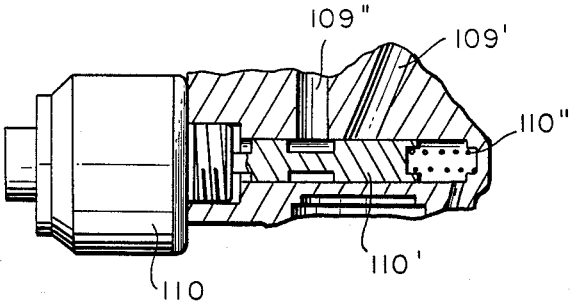
FIG. 13 is a view of the control valve shown closed.
Figure 14:
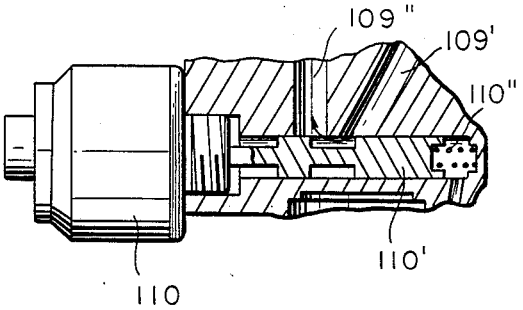
FIG. 14 is a view of the control valve shown opened.

As shown in FIGS. 11 and 12, an upstream passage portion 109' of the driving oil passage 109 extends from the oil pool 105 to underneath an electrical magnetic solenoid valve 110. A downstream passage portion 109'' of the driving oil passage 109 extends from underneath the electrical magnetic solenoid valve 110 to an oil passage 23 in the intake camshaft 2. The electrical magnetic solenoid valve 110 controls the communication between the upstream passage portion 109' and the downstream passage portion 109" as shown in FIGS. 13 and 14. Solenoid valve 110 includes a spool valve 110' that is biased by a spring 110" and is operated between a closed position (FIG. 13) and an open position (FIG. 14).

The oil pool 105 is formed between the intake camshaft 2 and the exhaust camshaft 101 at the end of cylinder head 1. As shown in the FIG. 11, the oil pool 105 is equipped with an accumulator 111. This accumulator 111 has a spring 114 pushing a ram 113 downward. The upper end of the spring 114 is supported by cap 112 fixed on the top of the accumulator 111. The oil passages 107 and 108 extend downward from the oil pool 105 and then extend parallel to the camshafts. Each oil passage, underneath the oil pool 105, has an obstruction or restriction 115. The oil passages 107 and 108 are formed with divergent oil passages 107*a* and 108*a* to supply oil to the cam journals 4, 106 and to the hydraulic lash adjusters.

Figure 2:
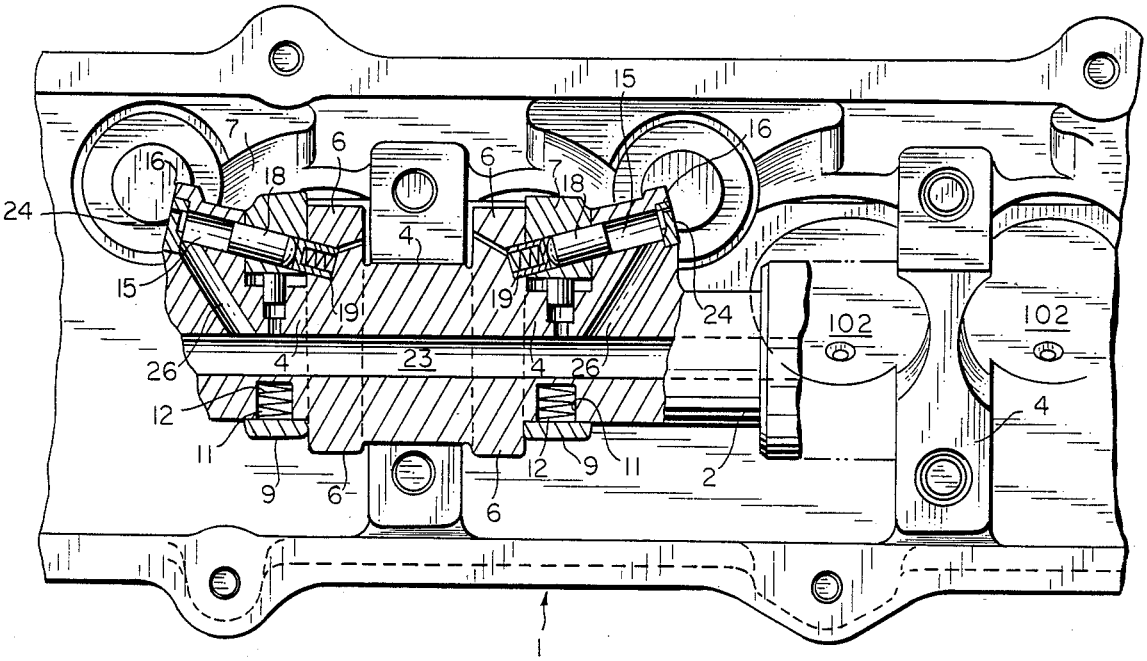
FIG. 2 is a partially enlarged and detail view of FIG. 1 partly in section.
Figure 4:
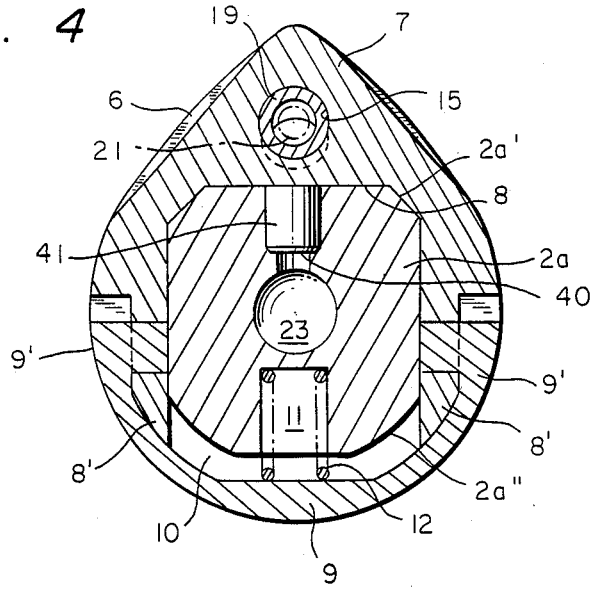
FIG. 4 is a cross-sectional view taken along line IV—IV of FIG. 3.

Referring to FIG. 2, a low speed cam member 6 is integrally formed with the intake camshaft 2. On the intake camshaft 2 adjacent the low speed cam member 6, a slim portion 2*a* of rectangular configuration is formed as shown in FIG. 4. A high speed cam member 7 is coupled with this slim position 2*a* so as to slide along the side surface of the low speed cam member 6. The high speed cam member 7 has a bottom 8 of concave configuration, which is fitted to one side 2*a*' of the slim portion 2*a*. The high speed cam member 7 can slide up to the height that the tip of the high speed cam member 7 protrudes beyond the low speed cam member 6. A cam cover 9 of U-shaped configuration is coupled with bifurcated legs 8' of the cam member 7 by being pressed toward the tip of the cam member 7. This cam cover 9 is made of spring steel so that arms 9' can be extended or spread widely enough to couple with the legs 8'.

Figure 3:
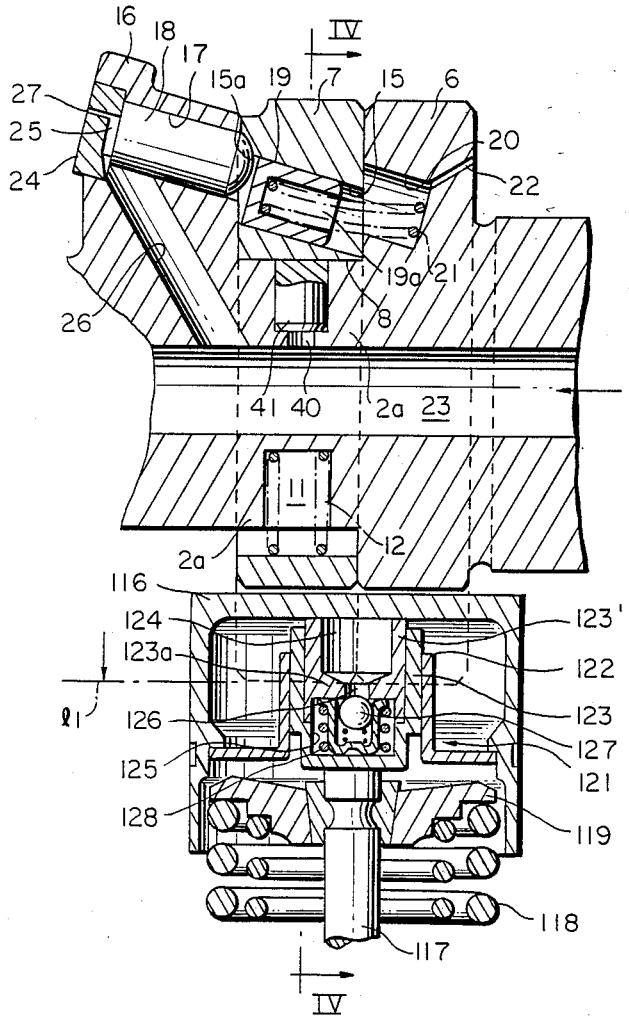
FIG. 3 is an axial sectional view showing a low speed cam member being able to drive a valve.

Between the cam cover 9 and the other side 2*a*" of the slim portion 2*a*, there is provided sufficient clearance 10 to allow the high speed cam 7 to slide. The slim portion 2*a* has a spring bore 11 on the other side 2*a*" so as to press the cam cover 9 by a compressed spring 12. Thus, the bottom 8 of the high speed cam member 7 is fitted firmly on the one side 2*a*' of the slim portion 2*a* as shown in FIGS. 3 and 4.

The high speed cam member 7 has such a profile that the silhouette of the high speed cam member 7 remains within an area of the low speed cam member when reflected or projected onto the surface normal to the axis of the intake camshaft 2, as shown in FIG. 4.

The high speed cam member 7 has a through hole 15. The axis of the through hole 15 declines or is inclined at a predetermined angle to the axis of the intake camshaft so that the distance between both axes decreases as approaching to the low speed cam member 6.

A pin support member 16 is formed integrally with the intake camshaft 2 adjacent to the high speed cam member 78 so that the high speed cam member 7 is sandwiched between the pin support member 16 and the low speed cam member 6. The pin support member 16 has a through 17 whose radius is the same as the through hole 15 and whose axis declines or is inclined at the same angel as the through hole 15. The through hole 17 is located so that its axis coincides with that of the through hole 15 when the high speed cam member 7 protrudes to its maximum outward position, see FIG. 5.

In the through hole 17, a connecting pin 18 is inserted to be slidable along the direction of the axis of the through hole 17. The connecting pin 18 has one end of semi-spherical configuration facing toward the high speed cam member 7. The high speed cam member 7 has a tapered surface 15*a* on the radially outer part of the entrance of the through hole 15. In the through hole 15, there is provided a receiver pin 19 slidable along the direction of the axis of the through hole 15. The receiver pin 19 has the same radius as the connecting pin 18, and has a bore 19*a* opening toward the low speed cam member 6 to house spring 21. This receiver pin 19 is formed shorter than the length of through hole 15.

The low speed cam member 6 is provided with a hole 20 having the same radius as through hole 15 and having its axis coincided with that of the through hole 15 when the high speed cam member 7 protrudes to its maximum outerward position. The spring 21 biases the receiver pin 19 toward the pin support member 16. An air relief passage 22 communicating the inside of the hole 20 with outside of the low speed cam member 6.

In the intake camshaft 2, the oil passage 23 is formed along the axis of the intake camshaft 2. Oil from an oil pump (not shown) is supplied to the oil passage 23.

The other end of the connecting pin 18 abuts to a plug 24 which covers the end of through hole 17 by being threaded into the large radius end of the through hole 17. The plug 24 has a bottom concavity so that there is provided an oil room 25 between the plug 24 and the connecting pin 18. An oil passage 26 connects the oil room 25 and the oil passage 23. An air relief passage 27 communicates the oil room 25 with the outside of the pin support member 16.

One end of the oil passage 23 is connected to the driving oil passage 109. The electrical magnetic solenoid valve 110 is adapted to shut the driving oil passage 109 in order to lower the oil pressure in the oil passage 23 when the engine speed is relatively low. Thus, the connecting pin 18 is held in the pin support member 16 by the expansion force of the spring 21, and the high speed cam member 7 is held at its retracted position by the expansion force of the spring 21.

Referring to the FIG. 3, a valve stem 117 for an intake valve is located underneath the tappet 116. A spring retainer 119 supporting a spring 118 is provided adjacent to the upper end of the valve stem 117. A hydraulic lash adjuster 121 (which is hereinafter abbreviated to an HLA) is provided between the tappet 116 and the valve stem 117 to automatically adjust any gap possibly induced between the top of the tappet 116 and the outer periphery of the low speed cam member 6.

HLA 121 has substantially cylindrical plunger 123 supported in sliding fit by an open ended guide cylinder 122 fixed to the tappet 116 for retractable movement. The plunger 123 telescopically water-tightly supports therein an inner cylindrical plunger 123' having a partition wall 123*a* which divides the inside of the plunger 123' into two chambers; namely, an upper oil chamber 124 and a lower oil chamber 125. These upper and lower oil chambers 124 and 125 are communicated with each other by means of an oil passage 126 defined by a hole formed in the partition wall 123*a*. In the lower oil chamber 125, there is a ball 127 (check valve) biased upwards by a coil spring 128 to stop up the oil passage 126. The plunger 123 thus structured can permit an oil flow from the upper oil chamber 124 into the lower oil chamber 125 but blocks the reversed oil flow. In consequence, if there is a gap produced between the top of the valve stem 117 and the bottom of the plunger 123, the pressure in the upper oil chamber 124 gets increases producing a pressure difference between the chambers.

This pressure difference forces down the ball 127 against the coil spring 128 to open the oil passage 126, causing an oil flow from the upper oil chamber 124 into the lower oil chamber 125 through the oil passage 126. As a result, the pressure applied in the lower oil chamber 125 gradually increase, forcing down the plunger 123 to bring it into abutment against the valve stem 117. In such way as described above, any gap induced between the valve stem 117 and plunger 123 is automatically removed.

As shown in FIGS. 3 and 4, the high speed cam member 7 is held at its retracted position in the lower engine speed region. Therefore the HLA 121 is driven by the low speed cam member 6 so that the top surface of the tappet 116 descends down to the line $1_1$ FIG. 3. On the other hand, the electric magnetic solenoid valve 110 opens the driving oil passage 109 when the engine speed is relatively high, resulting in the pressure rising in the oil passage 23. When the pressure rises, the pressure in the oil room 25 also rises. Consequently, the connecting pin 18 is moved against the spring 21 toward the high speed cam member 7. By virtue of the semi-spherical surface of the connecting pin 18 and the tapered surface 15*a* of the through hole 15, the connecting pin 18 can move the high speed cam member 7 outwardly normal to the axis of the intake camshaft 2 while the connecting pin 18 forces the receiver pin 19 against the spring 21.

Figure 6:
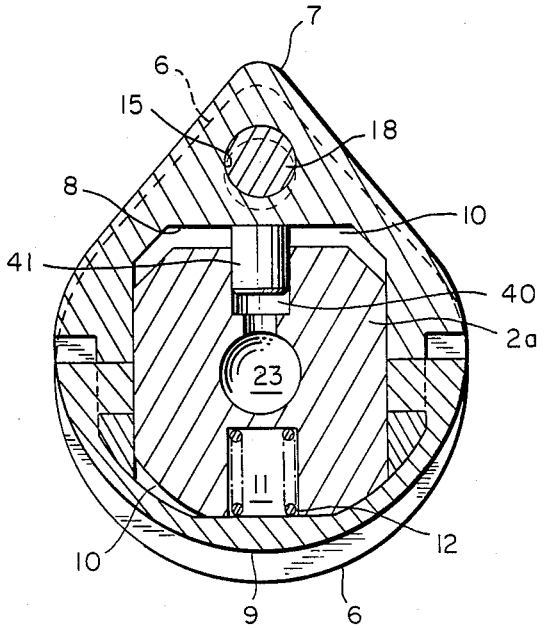
FIG. 6 is a cross-sectional view taken along line VI—VI of FIG. 5.
Figure 5:
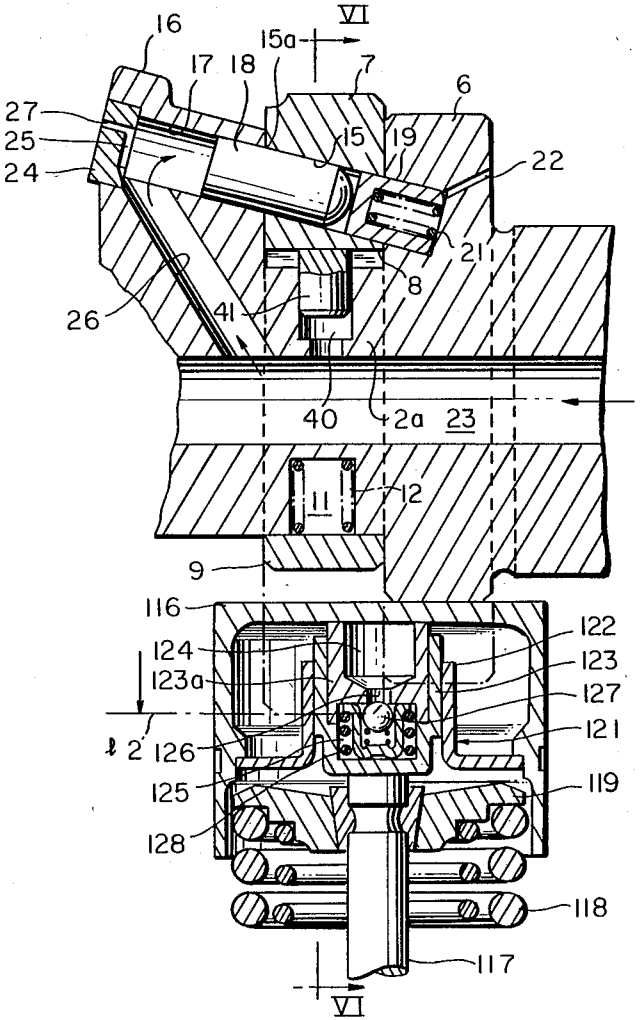
FIG. 5 is an axial sectional view showing a high speed cam member being able to drive a valve.

With the high speed cam member 7 protrudes at its maximum outward position, the connecting pin 18 is inserted or received into the through hole 15. At this time, the receiver pin 19 has been moved toward the hole 20 by the connecting pin 18. When the receiver pin 19 abuts the bottom of the hole 20, the connecting pin 18 is stopped. As shown in FIGS. 5 and 6, the profile of the high speed cam member 7 protrudes radially outwardly beyond the low speed cam member 6. Therefore, the HLA 121 is driven by the high speed cam member 7 so that the top surface of the tappet 116 descends down to the line $1_2$ of FIG. 5.

Furthermore, in the slim portion 2*a* there is an oil passage 40, which communicates the oil passage 23 with the top surface of the slim portion 2*a*. A pillar element 41 is disposed in the high speed cam member 7. This pillar element 41 may be formed integrally with the high speed cam member 7.

2. Second Embodiment of the Present Invention

Referring to FIGS. 7 to 10, a cam member 201 of circular configuration is formed integrally on the intake camshaft 2 instead of the low speed cam member 6 in the above-mentioned embodiment. A cam member 202 being slidable outwardly in the direction normal to the intake camshaft 2 is provided adjacent to the cam member 201. Except for the pillar element embodiment, and therefore, further detailed explanation is omitted.

Figure 7:
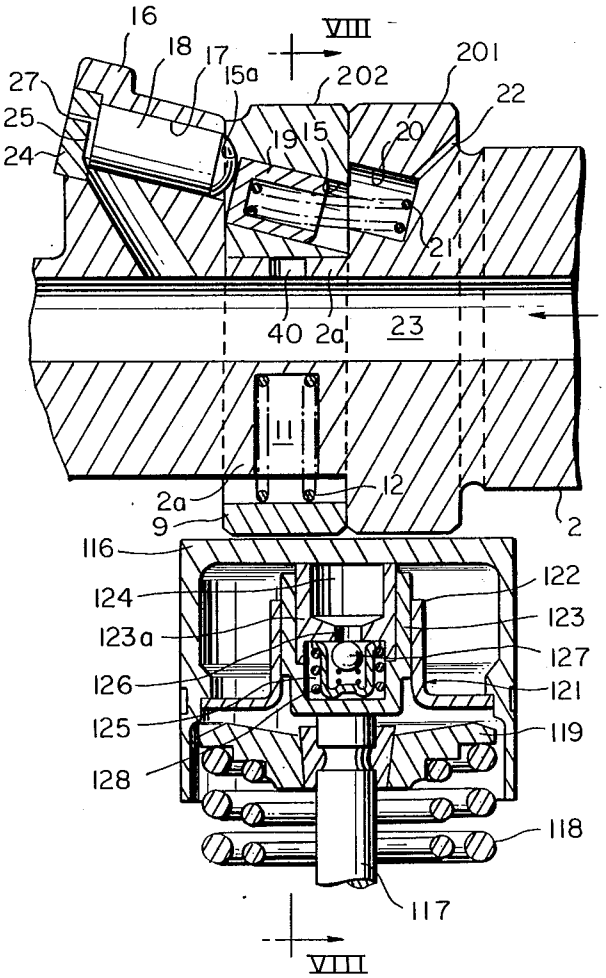
FIG. 7 is a detail axial sectional view of a second embodiment showing a moving cam member not driving a valve.
Figure 8:
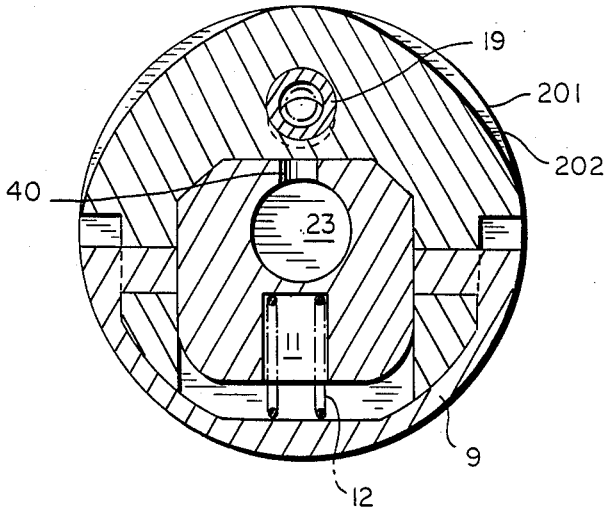
FIG. 8 is a cross-sectional view taken along line VIII—VIII of FIG. 7.
Figure 10:
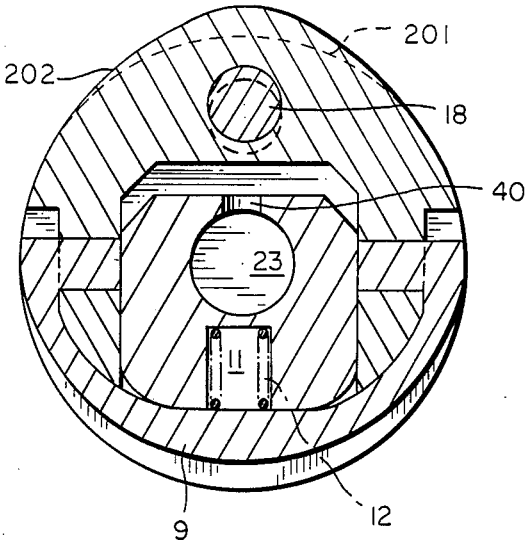
FIG. 10 is a cross-sectional view taken along line X—X of FIG. 9.
Figure 9:
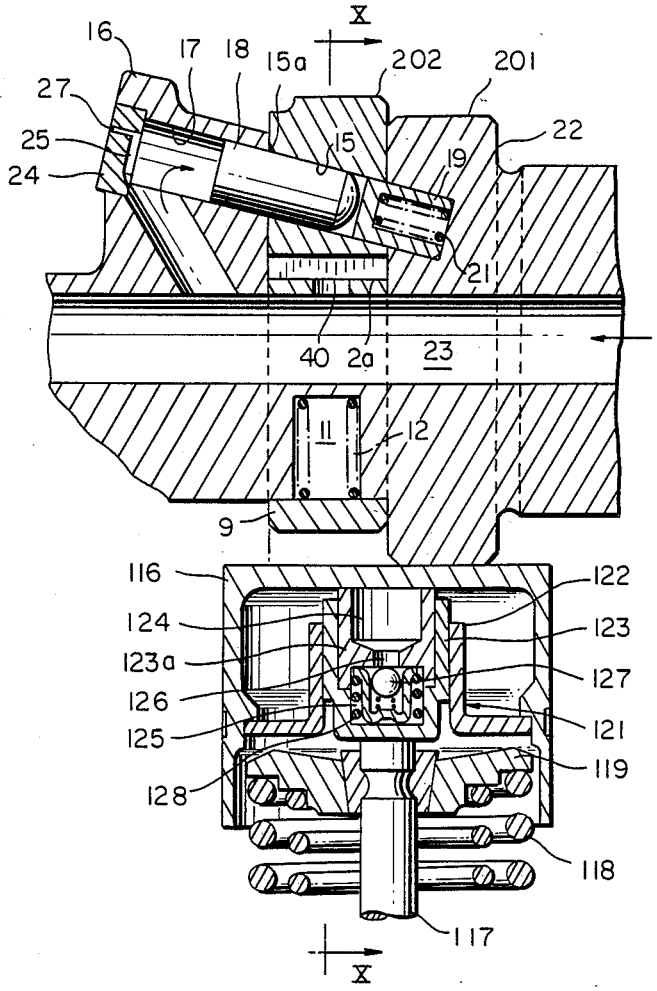
FIG. 9 is a detail axial sectional view of the second embodiment showing a moving cam member driving a valve.

When the cam member 202 is held at the retracted position as shown in FIGS. 7 and 8, neither the cam member 201 nor the cam member 202 can drive the valve stem 117 because of circular configuration of the cam member 201. However, when the cam member 202 is held at its maximum radial outward position, as shown in FIGS. 9 and 10, the cam member 202 can drive the valve stem 117 by reciprocating it upwardly and downwardly. Such a mechanism is useful for an engine having a plurality of intake valves and/or a plurality of exhaust valves to stop some of these valves or render them temporarily inactive.

3. Third Embodiment of the Present Invention

Figure 15A:
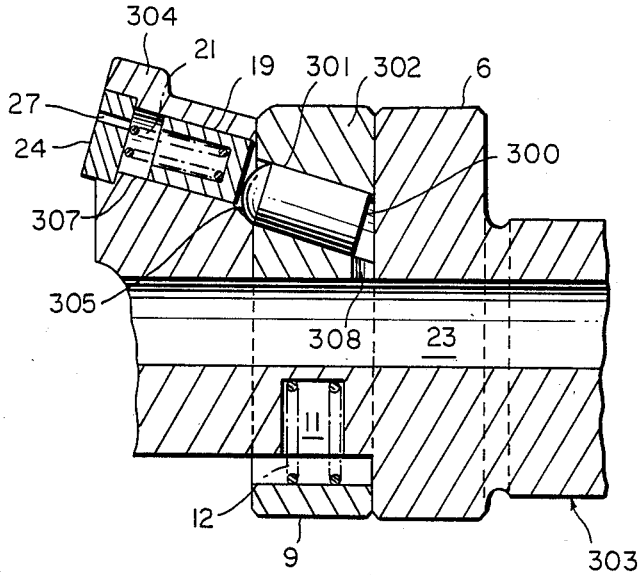
FIGS. 15(*a*) and 15(*b*) are detail axial sectional views of a third embodiment.
Figure 15B:
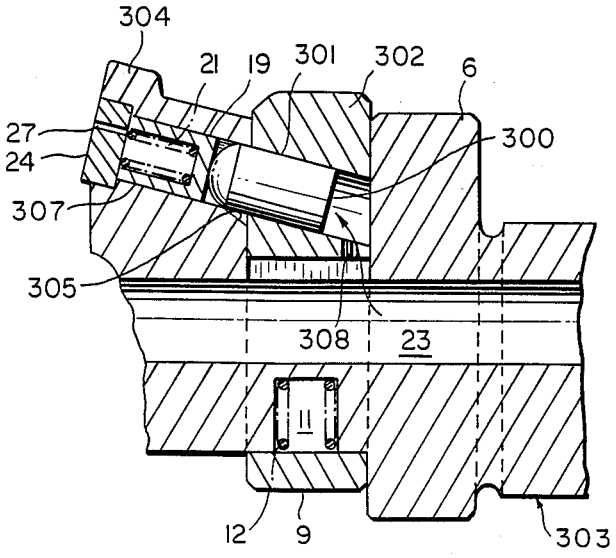
Figure 16A:
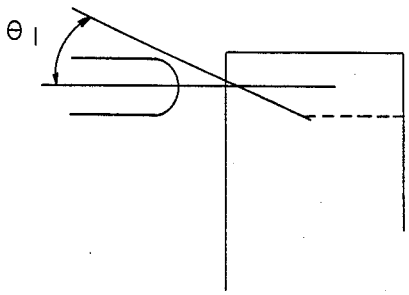
FIGS. 16(*a*), 16(*b*), 16(*c*) and 16(*d*) are illustrative views showing the effect of the declination or inclination of the connecting pin.
Figure 16B:
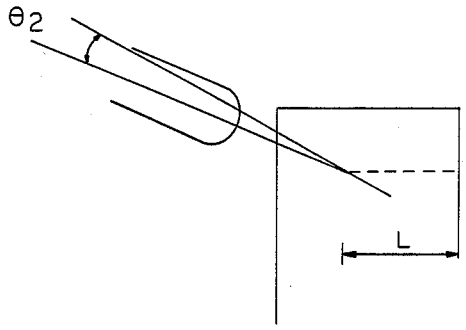
Figure 16C:
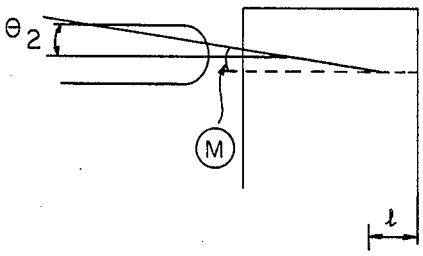
Figure 16D:
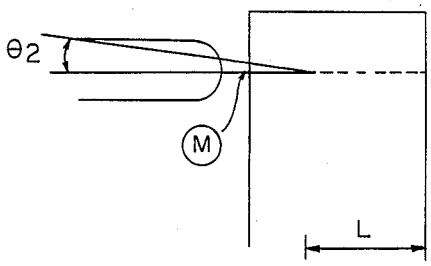

Referring to FIGS. 15(*a*) and 15(*b*), the connecting pin 300 is located in a through hole 301 of a movable cam member 302. The through hole 301 has an inclined axis which inclines upwardly away from the axis of intake camshaft 303 as it approaches to a fixed member 304. The fixed member 304 has a tapered portion 305 at its radially inward part of its entrance. A receiver pin 306 is located in a through hole 307 in the fixed member 304. An oil passage 308 is formed in the movable cam member 302 to supply oil to the connecting pin 301. Other features are the same as the first embodiment. FIG. 15(*a*) shows the retracted position, and FIG. 15(*b*) shows the protruding position. Operational explanation is omitted because it is basically the same as the first embodiment.

4. Effect of the Declination or Inclination of the Connecting Pin

Referring to FIGS. 16(*a*), 16(*b*), 16(*c*) and 16(*d*), the effect of the declination or inclination can be described as follows. From the viewpoint of force needed to insert the connecting pin into the cam member, locating the connecting pin in the direction parallel to the axis of the camshaft is not sufficient because of the relatively large angle between the axis of the connecting pin and the axis of the camshaft. The example of FIG. 16(*b*) is desirable compared with that of FIG. 16(*a*) because of the smaller angle $0_2$. ($O_2 < O_1$)

If a smaller angle $O_2$ is adopted and the connecting pin is disposed parallel to the axis of the camshaft, the tapered portion of the cam member become deep and the stiffness is lowered. (See the difference between L and 1 in FIGS. 16(*b*) and 16(*c*)). Otherwise, entrance height of the through hole of the cam member become short and the cam cannot be lifted to the necessary height. (See the difference between and in FIGS. 16(*c*) and 16(*d*).

Although the invention has been shown with reference to the specific embodiments, changes are possible. Such changes which are apparent to those skilled in the art are deemed to fall within the purview of the invention as stated in the appended claims.

What is claimed is:

1. An engine valve driving apparatus for internal combustion engine comprising, a camshaft rotatable in synchronism with rotation of an engine crankshaft, a first cam member fixed on said camshaft, a second cam member supported by said camshaft for radial movement between a projected and a retracted position;

both cam members defining holes whose axes coincide with each other when the second cam member is held at its projected position, a connecting pin disposed in one of said holes for moving the second cam member radially outwardly by shifting from the hole in which it is disposed toward the other holes, and oil supply means for supplying oil to shift said connecting pin to move the second cam member radially outwardly to its projected position.

2. An engine valve driving apparatus in accordance with claim 1, wherein said holes decline at a predetermined angle to the axis of said camshaft.

3. An engine valve driving apparatus in accordance with claim 1, wherein said connecting pin fixes said movable cam member at its projected position.

4. An engine valve driving apparatus in accordance with claim 1, wherein the other hole has a tapered portion for co-acting with said connecting pin when the second cam member is moved radially outwardly.

5. An engine valve driving apparatus in accordance with claim 4, wherein said connecting pin has a end of semi-spherical configuration to coact with said tapered portion.

6. An engine valve driving apparatus in accordance with claim 1, wherein said oil supply means includes an oil supply passage to supply oil to the connecting pin from an oil room having an accumulator, and another oil passage to supply oil from the oil room to a cam journal of the camshaft.

7. An engine valve driving apparatus in accordance with claim 6, wherein said another oil passage has a restriction therein.

8. An engine valve driving apparatus in accordance with claim 1, wherein said cam members are mounted on the camshaft adjacent to one another.

9. An engine valve driving apparatus in accordance with claim 8, wherein said second cam member has a profile such that it protrudes radially outward beyond the first cam member when in its projected position.

10. An engine valve driving apparatus in accordance with claim 1 further comprising auxiliary actuating means for lifting said second cam member responsive to oil pressure applied thereto.

* * * * *